United States Patent [19]

Shell

[11] 4,432,689

[45] Feb. 21, 1984

[54] APPARATUS AND METHOD FOR HANDLING CARGO USING FLEXIBLE SUPPORT STRAPS

[76] Inventor: Melvin E. Shell, Box 1121, Stephenville, Tex. 76401

[21] Appl. No.: 306,315

[22] Filed: Sep. 28, 1981

[51] Int. Cl.[3] ..... B66C 1/18

[52] U.S. Cl. ..... 414/416; 108/52.1; 108/55.1; 294/67 E; 294/74; 414/786

[58] Field of Search ..... 414/416, 417, 608, 785, 414/786; 108/52.1, 55.1; 294/67 E, 67 EA, 67 R, 74, 75; 212/82, 85, 135

[56] References Cited

U.S. PATENT DOCUMENTS

| | | | |
|---|---|---|---|
| 2,634,154 | 4/1953 | O'Brien | 294/75 |
| 2,692,056 | 10/1954 | Woods | 212/135 |
| 3,263,599 | 8/1966 | Dickens . | |
| 3,376,807 | 4/1968 | Sterner . | |
| 3,406,845 | 10/1968 | Fahey | 294/75 X |
| 3,411,434 | 11/1968 | Sylvester et al. . | |
| 3,494,490 | 2/1970 | Shell | 108/55.1 X |
| 3,566,780 | 3/1971 | Chisek et al. . | |
| 3,949,662 | 4/1976 | Woomer . | |
| 4,091,723 | 5/1978 | Izawa . | |

*Primary Examiner*—Robert G. Sheridan

*Attorney, Agent, or Firm*—Hubbard, Thurman, Turner & Tucker

[57] ABSTRACT

A cargo suspension frame apparatus from which an aggregated or unitized block of discrete cargo units may be suspended by flexible straps so that the block of cargo is held immediately below the suspension frame and free of any lower pallet. The suspension frame has been adapted for use in conjunction with an ordinary forklift and is fitted with a sling for use in cooperation with a dockside crane. On the upper edge of at least two sides of the suspension frame, cylindrical reels are rotatably disposed at spaced positions to wind and unwind the straps. A manual or power actuated set of locking cams releasably connects the opposite ends of the straps to the suspension frame. The reels are turned in a winding or unwinding direction by an electric gear motor or a hydrostatic drive unit.

12 Claims, 10 Drawing Figures

APPARATUS AND METHOD FOR HANDLING CARGO USING FLEXIBLE SUPPORT STRAPS

BACKGROUND OF THE INVENTION

1. Field of the Invention

The present invention relates to cargo handling systems intended for use in loading materials from a dock into the cargo hold of a ship, truck or railcar.

2. Background Art

There have been many devices and methods used in loading cargo into the holds of deep water vessels and other haulage vehicles. Conveyor belts and pipes are used for particulate and fluid matter. Loads consisting of larger discrete objects are often handled by means of a cargo net or by means of large portable containers. The handling of a collection of discrete cargo units has presented a particular problem because of the expensive and time-consuming manual labor required for loading and unloading the various transport apparatus used for conveying a bulk of such cargo units between a dock and a ship, for example. Another disadvantage of prior art methods and apparatus for handling discrete cargo units is the necessity for leaving bulky, space-wasting wooden pallets beneath a load during transit. Such lost space can usually only be conserved by manually transferring cargo from the pallet into the transport vehicle.

Cargo delivered between a ship and a dock by means of prior art devices generally requires the intervention of a team of stevedores at both the dock and ship stations. The stevedores in the cargo hold of the ship must manually remove discrete cargo units from the cargo net or similar loading device and reassemble these units on a pallet for transport to a remote section of the hold. In the process of stacking the cargo units at their assigned location in the hold, the cargo units typically are handled individually or remain on the space consuming pallet.

There have also been many prior art methods of loading cargo on to trucks and railcars. Discrete cargo units are normally loaded into a truck in serial fashion, unless a pallet remains under the load. Serial loading also requires a great deal of time and labor. There has long been a need in the cargo handling art for a device that could be used to place an entire load made up of a plurality of discrete units within a truck or other conveyance at one time and in one simple maneuver. There has also been a need for a loading article that allows placement of a load directly on the floor of a transport vehicle without retention of a pallet with the load.

Accordingly, it is an object of this invention to provide improved apparatus useful for loading discrete cargo units on to a ship,truck or other vehicle so that the vehicle is filled to capacity in a series of one or more simple maneuvers.

It is a further object of this invention to provide a more expeditious cargo handling process by means of which the number of stevedores in a ship's hold is reduced to one forklift operator, for example.

Yet another object of the present invention is to provide a suitable means for handling a plurality of discrete cargo units of irregular shape and to provide a convenient means for removing transport straps from around an aggregated group of cargo units.

SUMMARY OF THE INVENTION

The cargo handling system of this invention makes use of an improved apparatus designed to hold an aggregated block or load of discrete cargo units suspended beneath it. The cargo handling system may also be used to handle items of irregular shape such as elongated rolls of cargo material. The improved apparatus, herein referred to as a cargo suspension frame, is adapted to receive the tines of an ordinary large forklift or equivalent devices such as are commonly found at loading dock and warehouse facilities. The cargo suspension frame is designed to be placed on top of its cargo load and is provided with straps depending from opposite sides for securing the cargo beneath it.

Cargo to be loaded by the apparatus of the present invention preferably comprises bags and/or boxes having uniform rectangular dimensions. These units of cargo are stacked upon a dockside strapping platform so that the individual units contained within a layer of the block of cargo are generally aligned with one another and with the units of the adjoining layer or layers so as to form a somewhat solid aggregated block of cargo.

When the cargo has been aggregated as previously described, the suspension frame is placed on top of the top layer of cargo units. Straps attached to the cargo suspension frame are then run around and underneath the block of cargo from at least two sides. Alternatively, sets of straps are initially laid beneath the cargo block before it is formed. The straps are then connected at their opposite end portions to the suspension frame by improved connection means between the straps and the frame including strap winding reels or drums and tensioning cams mounted on the frame.

Further in accordance with the present invention, the cargo straps may be moved while disposed underneath the block of aggregated cargo units because portions of this block are held in spaced relation to a dockside strapping frame. The strapping frame is adapted to support the block of cargo and, at the same time, provides open troughs underneath the cargo through which the straps may be run and tightened without binding the strapping frame to the cargo.

In accordance with yet another aspect of the present invention, the cargo straps are secured on opposite sides of the suspension frame by means of eccentric friction cam locks. After being secured to the suspension frame, it is possible for an ordinary forklift truck or the like to hoist the entire load by placing its tines within slots provided in the suspension frame and lifting the frame along with the cargo that is suspended below it. The forklift may then carry the suspended load beneath the frame to that portion of the dock accessible to a loading crane.

A loading crane may then be attached to the suspension frame by means of a sling or similar hook means provided on the top side of the frame. The crane may then lift the suspension frame and its suspended cargo from the dock surface and carry it over into the ship's hold or other cargo receiving structure. In the ship's hold another forklift may pick up the frame and carry it and its suspended cargo to that portion of the hold assigned to the particular load. Once the load has come to rest in its assigned position, all that remains to be done is release and extract the cargo tie straps so that the suspension frame may be removed and retuned to the dock for serial loading operations. Alternatively, the straps may be completely released from the frame and left with the block of cargo for use in unloading at the destination by another frame apparatus.

Provision is made on the suspension frame to facilitate the removal of the cargo tie straps from beneath the cargo block when at rest in the ship's hold if desired. The apparatus used for removing the tie straps comprises a plurality of reels turned in tandem by means of an electric or hydraulic motor and a linkage operable by a single lever for releasing the eccentric cam locks. After one end of each of the straps is disconnected from its eccentric cam lock, the straps are wound on respective drums or reels along a side of the suspension frame opposite the respective eccentric cam locks used for a particular strap. The reels are turned simultaneously by means of one or more drive shafts operably connected to the motor. Adjacent tie straps are reeled from underneath the load in opposite directions in order to minimize the possibility that the load might be pulled over or torn apart as the straps are withdrawn from beneath the load.

After reeling is completed and the straps are fully wound upon their reels, the suspension frame may again be picked up by a forklift and carried back to a point in the cargo hold accessible to the dockside crane. The suspension frame is then picked up by the crane and redeposited on the dock. The process is then repeated.

An alternative cargo handling system is useful for loading tubular rolls or other irregularly shaped cargo units which must be contained or will not be stable when stacked on top of one another. The cargo suspension frame for use with the alternative system is identical to that described above. However, the dockside strapping frame includes two upstanding sidewalls for containing the cargo units prior to attachment to the suspension frame. According to this alternative procedure, the tie straps are laid along the bottom and up the sidewalls of the frame prior to its being filled with the cargo units. When the trough formed by the frame is filled, the straps are attached to the suspension frame so that the frame can be lifted with all of the cargo units suspended below it. The frame may then be handled in one or more of the ways previously described.

Those skilled in the art will recognize other superior features and advantages of the present invention upon reading the detailed description which follows.

DESCRIPTION OF THE PREFERRED EMBODIMENTS

Figure 5:
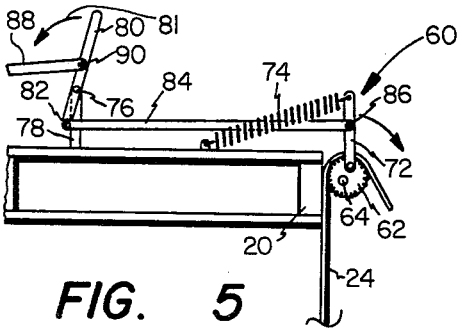
FIG. 5 is a detail of an alternate embodiment of an eccentric strap lock mechanism.

Referring now to the drawing figures wherein like numerals designate like parts, preferred embodiments of the invention will be described in detail.

Figure 1:
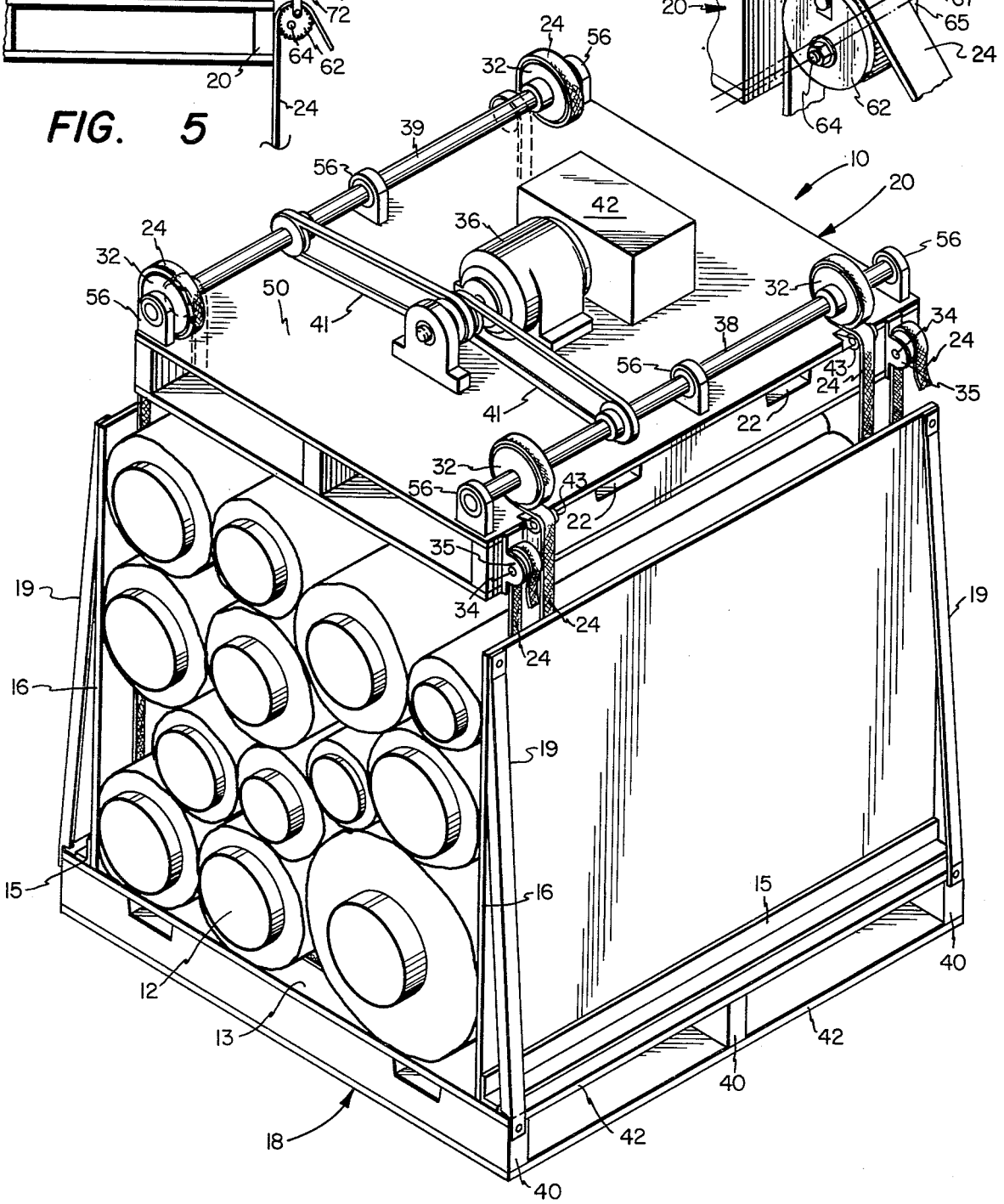
FIG. 1 is a perspective view showing one embodiment of the cargo handling system of the present invention.

With reference to FIG. 1, one embodiment of the cargo handling system is illustrated, generally designated by the numeral 10, and is shown in association with an assortment of elongated rolls or cargo units 12. The cargo units 12 are stacked on the floor surface 13 of a dockside support frame 18 and are held against horizontal movement by spaced apart sidewalls 16. The sidewalls 16 are braced by structural metal angle members 15 and struts 19.

The frame 18 includes a base portion approximately six feet wide and at least six feet long which may be made out of parallel lengths of two inch by six inch wooden beams 40, each beam oriented so that the narrower edges are vertically aligned. The beams 40 are interconnected along coplanar edges by means of three-quarter inch plywood decking 42 so that uniform top and bottom surfaces are created on frame 18.

The frame 18 may be provided with a pattern of upwardly opening strap receiving channels, not shown, and formed in the floor 13. These channels may be formed in any of several ways. For example, three-quarter inch plywood decking may be cut into five inch squares and placed on the floor surface 13 of dockside frame 18 so that two inch spaces between adjacent squares form parallel and perpendicular channels having intersections at five inch intervals. Alternatively, similar strap receiving channels may be made by cutting grooves into the floor surface 13. Non-intersecting parallel channels could be formed simply by attaching one inch by four inch wood strips, broad side down, at spaced intervals across the floor surface 13. Also, pairs of quarter round dowel stock sections could be used to form individual channels with cuts made at points of intersection. The various ways of creating channels can be modified to create channels of varying widths.

Figure 3:
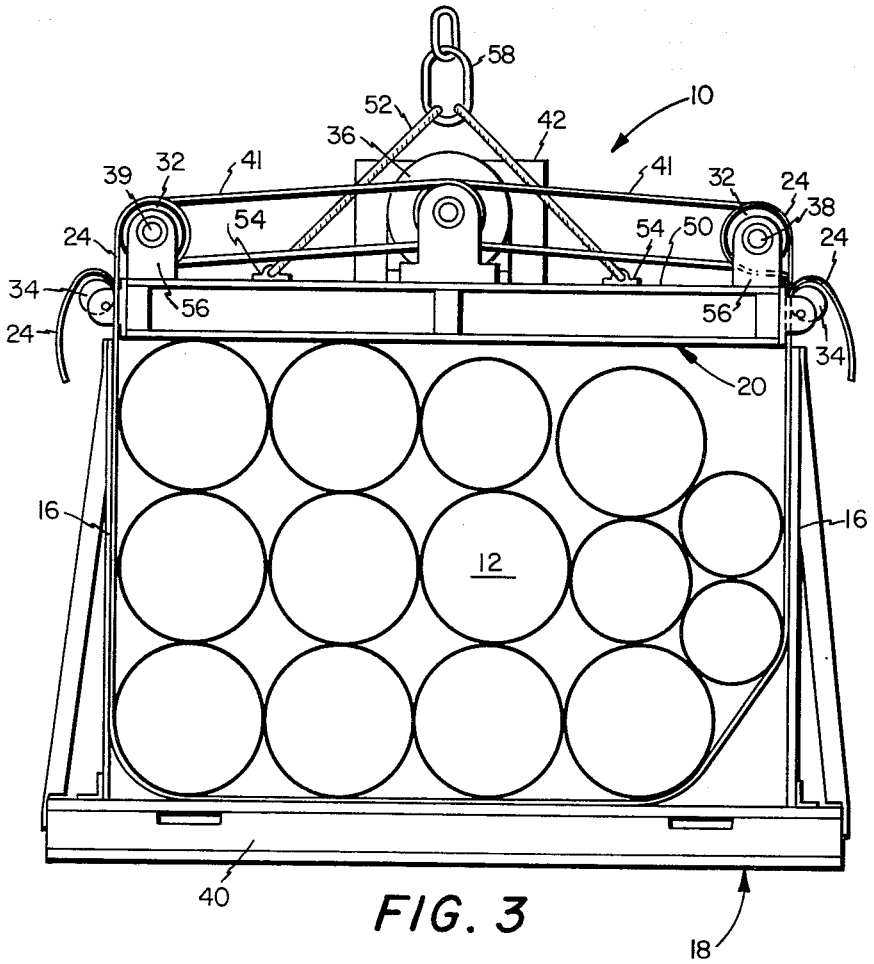
FIG. 3 is a front elevational view showing the cargo suspension frame in place above the dockside frame of FIG. 2.
Figure 4:
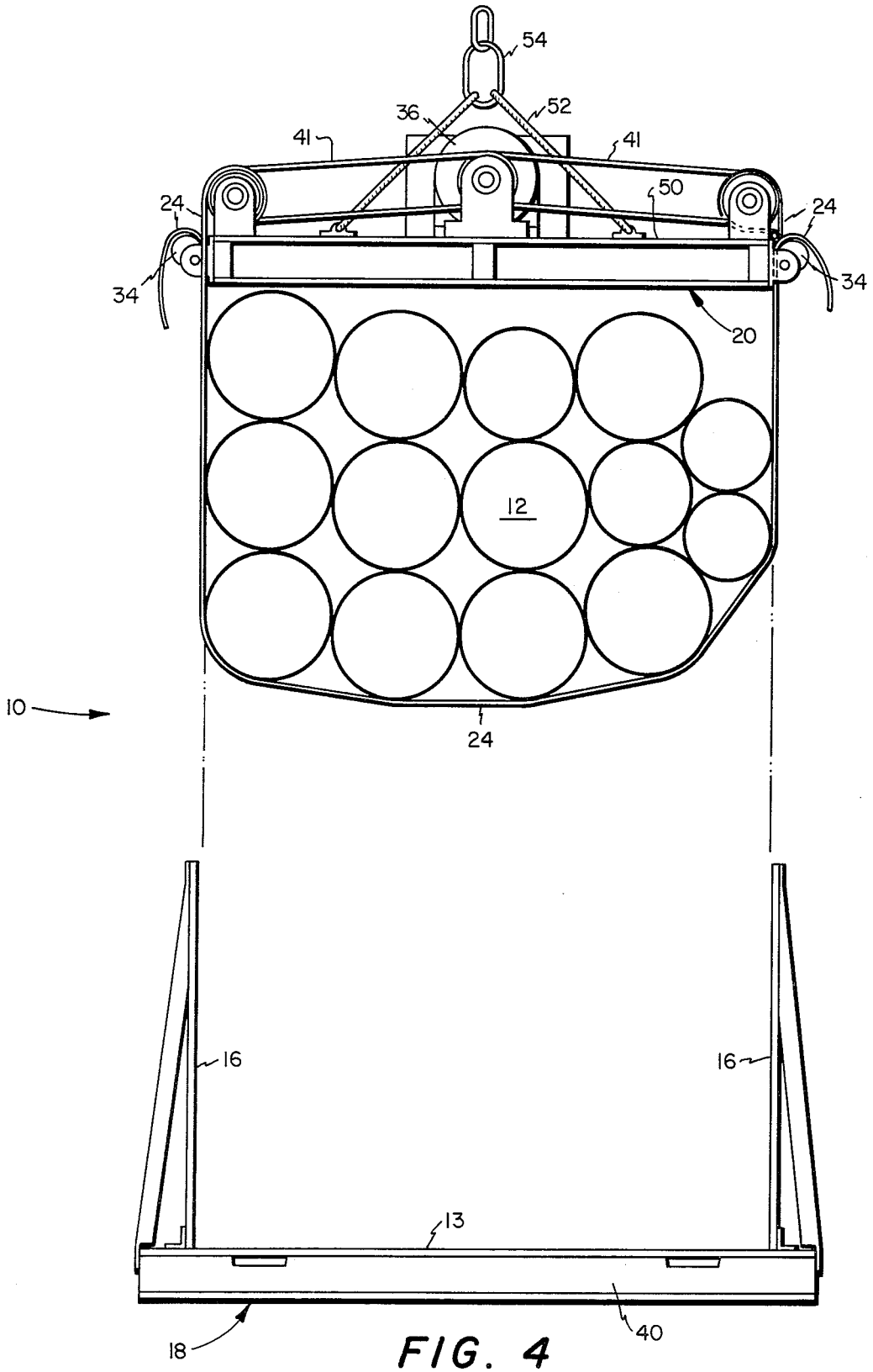
FIG. 4 is a front elevational view showing elongated tubular cargo units suspended beneath the cargo suspension frame after hoisting the same out of the dockside frame.

The cargo handling system 10 includes a cargo suspension frame 20 comprising a two-way entry forklift pallet 50 similar to the base portion of frame 18 and measuring approximately six feet wide and six feet long. Cables 52, shown in FIGS. 3 and 4, are secured to pallet 50 by a clevis and pin combination 54, shown in FIG. 3. Ring 58 is attached to cables 52 for use in lifting suspension frame 20. Forklift tines may be received at ports 22 of the pallet 50 or between the spaced apart deck pieces forming the pallet. Disposed along two parallel edges of pallet 50 are shafts 38 and 39 rotatably mounted on the pallet by means of bearing blocks 56. On each shaft 38 and 39 are mounted at least one and preferably two winding drums or reels 32. Cargo straps 24 are wound on to and off of reels 32 when shafts 38 and 39 are turned within the bearing blocks 56. The straps 24 depend from the reels 32 in alternating sequence so that each strap crosses beneath the cargo suspension frame 20 in a direction parallel to that of the adjacent strap. The straps 24 are shown passing beneath the aggregated block of cargo units 12. The free end of straps 24 are attached to the suspension frame 20 by means of eccentric friction cam locks 34. Friction locks 34 are disposed along the outside edges of the pallet portion 50 at spaced intervals and comprise cylindrical roller cams which are mounted in suitable brackets 35 for rotation about an axis in such a way that straps 24 may be pinched between the base of each of the brackets and the surface of the rollers to releasably secure the straps to the frame 20.

The reels 32 are operated by a motor 36 operably connected to shafts 38 and 39 by means of V-belts or chains 41. Straps 24 depend from reels 32 each in a direction opposite that of its neighbor so that when drive shafts 38 and 39 are turned in one direction, the tie straps are pulled upwards from a side of the cargo suspension frame 20 opposite that of its immediately adjacent neighbor. Since the shafts 38 and 39 are rotating in the same direction, the straps depending from reels 32 on shaft 38 are wound on the reels in the same direction as the straps wound on the reels mounted on shaft 39 and, accordingly, are trained over suitable idler rollers 43 mounted on the pallet 50.

The motor 36 may be an electric motor and provided with a battery 42 as a power source. Connection between power source 42 and electric motor 36 is of a conventional type, including a remote switch, not shown, for reversing motor rotation. The motor may also be of the integral gear type including a reduction gear drive, interposed between the motor output shaft and the belts 41 and operable to be rotatably driven only from the motor side.

Figure 2:
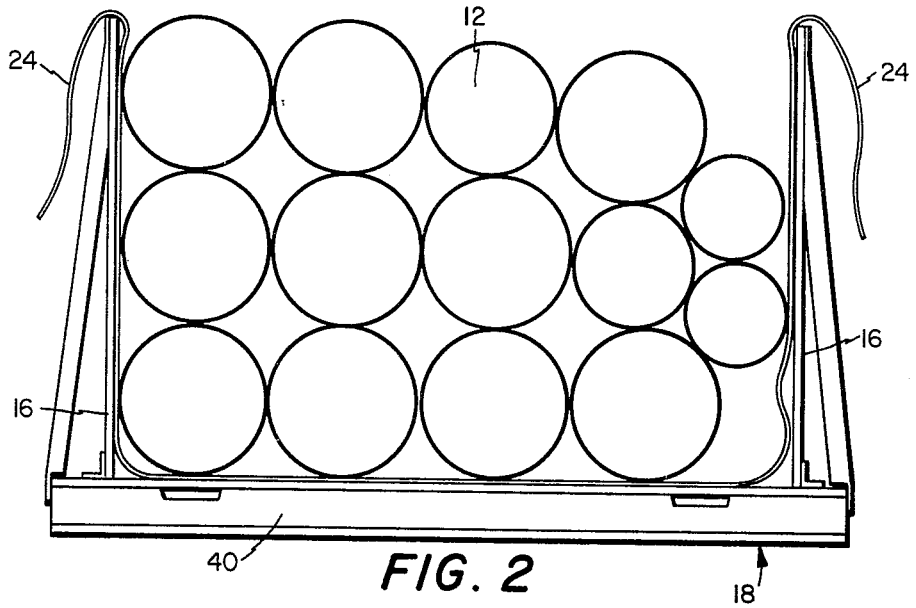
FIG. 2 is a front elevational view showing the dockside strapping frame in use with elongated tubular cargo units according to the method and apparatus of the present invention.

Referring now to FIGS. 2, 3 and 4, the operation of the suspension frame 20, in cooperation with the dockside frame 18 will be described. In FIG. 2, cargo tie straps 24 are shown hanging over the top edges of walls 16 and ready for attachment to reels 32 and friction locks 34 of the cargo frame 20. In FIG. 3, the suspension frame 20 has been placed over dockside frame 18 and straps 24 have been wound on the reels 32, engaged with eccentric cam locks 34 and tightened by operation of motor 36. In FIG. 4, the suspension frame 20 and suspended cargo units 12 have been lifted clear of dockside frame 18. The load may also be raised by a conventional forklift, not shown, the tines of which are inserted into ports 22 of frame 20 or between the deck pieces of the pallet 50 and the load is then deposited within the interior of a truck trailer or other cargo container, for example. Once at the destination, the strap locks are actuated to release one end of each strap 24. Electric power source 42 is then connected to electric motor 36 so that drive shafts 38 and 39 are rotated and the straps 24 are wound onto reels 32. When the straps 24 have been completely wound onto reels 32, cargo suspension frame 20 is returned for picking up another load and the straps 24 are unwound so that the procedure may be repeated. Alternatively, the straps could be disconnected from the strap locks 34 and the reels 32 and left with the load for use in removing the load by another suspension frame 20 at the final destination or unloading site. It is within the spirit and scope of this invention to provide various means of lifting cargo suspension frame 20 in addition to forklifts and cranes.

Figure 10:
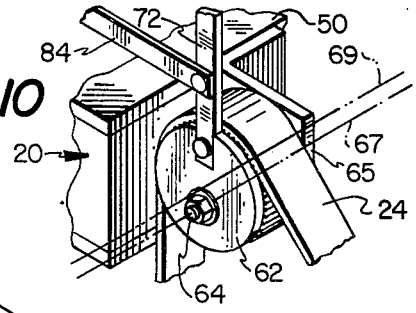
FIG. 10 is a detail perspective view of one of the strap locking cams.

FIGS. 5 and 10 illustrate an alternate embodiment of the strap lock mechanism 34 shown in FIG. 1. In the embodiment of FIGS. 5 and 10, a strap lock mechanism, generally designated 60, includes a plurality of eccentric cylindrical roller cams 62 mounted on bearing shafts 64 in place of the lock mechanisms 34. Each shaft 64 is adapted to be mounted on a bracket 65, as shown in FIG. 10, which bracket is fixed to the sidewall of the suspension frame 20. In FIGS. 5 and 10 a strap 24 is shown wedged between cam 62 and suspension frame 20. The surface of cam 62 may be serrated, as shown, to improve the gripping action on the straps 24. Moreover, the axis of rotation of the cam 62 about the shaft 64 is positioned such that a generally vertical downward force on strap 24 tends to rotate the cam 62 about an axis 67 eccentric to the central axis 69 of the cam to pinch the strap between the cam and the sidewall of the pallet portion 50 of the suspension frame.

The strap lock mechanism 60 also includes a novel release mechanism including a crank arm 72 fixed to one side of each cam 62. A spring 74 is connected between the other end of the crank arm 72 and to the suspension frame 20. The spring 74 biases the arm 72 towards the suspension frame 20. The biasing force of spring 74 causes tie strap 24 to be wedged between cam 62 and suspension frame 20 regardless of whether or not any other force is being applied to strap 24.

A pivot member 76, having its axis of rotation generally parallel to the fixed eccentric axis of cam 62, is mounted on a support block 78 fixed to the suspension frame 20. Mounted on pivot member 76 is a rocker lever 80. Rocker lever 80 is a two-arm lever having its fulcrum at the axis of pivot member 76. One arm of rocker lever 80 is attached at pivot connection 82 to one end of floating link 84. Floating link 84 is connected at its other end to crank arm 72 at a pivot connection 86.

Another arm of rocker lever 80 may be connected to another floating link 88 at upper pivot connection 90. The additional floating link 88 may be attached to the cam 62 disposed on the other side of the suspension frame 20. When a plurality of eccentric cam locks 62 are operated in tandem by the application of force to the upper arm of rocker lever 80, a convenient means is provided for simultaneously releasing all of the straps 24 from wedged engagement with their respective cams. When the arm 80 is rotated in the direction of the arrow 81 in FIG. 5, the links 84 and 88 are actuated to rotate the cams 62 to release the cargo straps.

Another embodiment of the cargo handling system of the present invention is illustrated in FIGS. 6 through 9 of the drawings. The cargo handling system of FIGS. 6 through 9 may utilize a pallet of one or more types such as, for example, the pallet and depalletizing equipment disclosed in my U.S. Pat. No. 3,494,490. Moreover, a pallet of the type as disclosed in FIG. 6 of the drawings and generally designated by the numeral 102 may also be used, as illustrated and described herein. The pallet 102 is of conventional construction except that the cargo support surface 104 has a plurality of intersecting slots 106 and 108 provided of a sufficient depth to receive the cargo straps 24 and to be used with the suspension frame 20 as well as a variation of the suspension frame to be described in further detail herein. The slots 106 and 108 are of sufficient depth to enable the straps to be easily pushed or pulled through the slots even when the pallet is stacked with a plurality of cargo units such as the rectangular containers 107, illustrated in FIG. 6.

Figure 7:
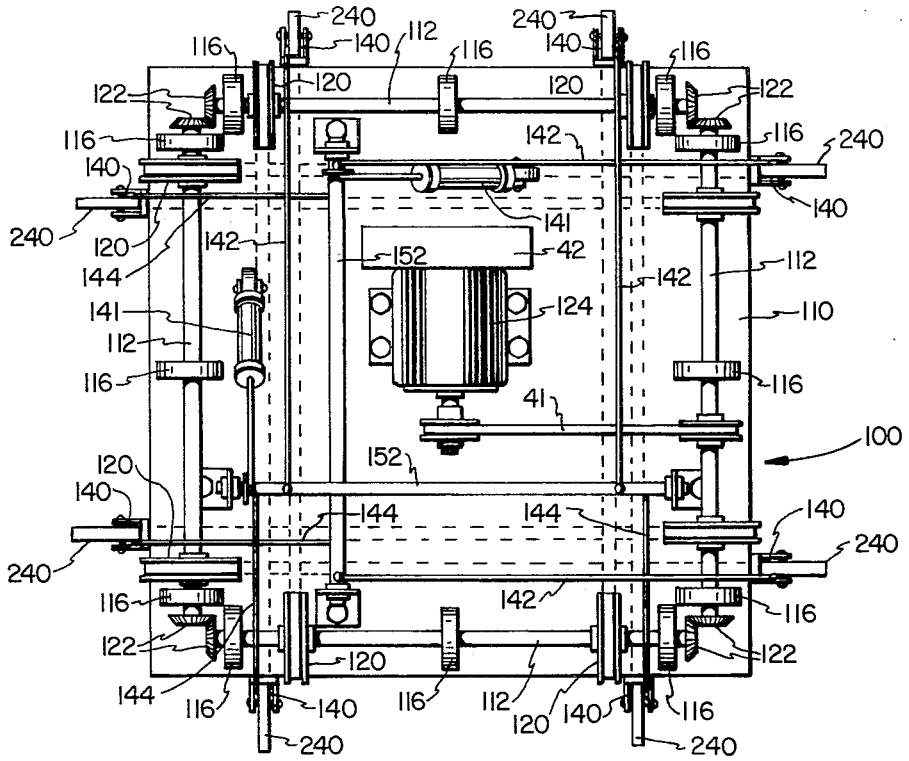
FIG. 7 is a plan view of an alternate embodiment of a cargo suspension frame.

Referring to FIG. 7, a suspension frame generally designated by the numeral 100, includes a main frame or pallet member 110 similar to the pallet member 50 and on which are mounted respective rotatable shafts 112 suitably mounted on spaced apart pillow blocks 116.

Figure 9:
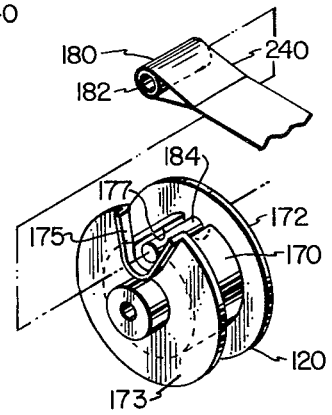
FIG. 9 is a detail perspective view of a modification of the strap reels.
Figure 6:
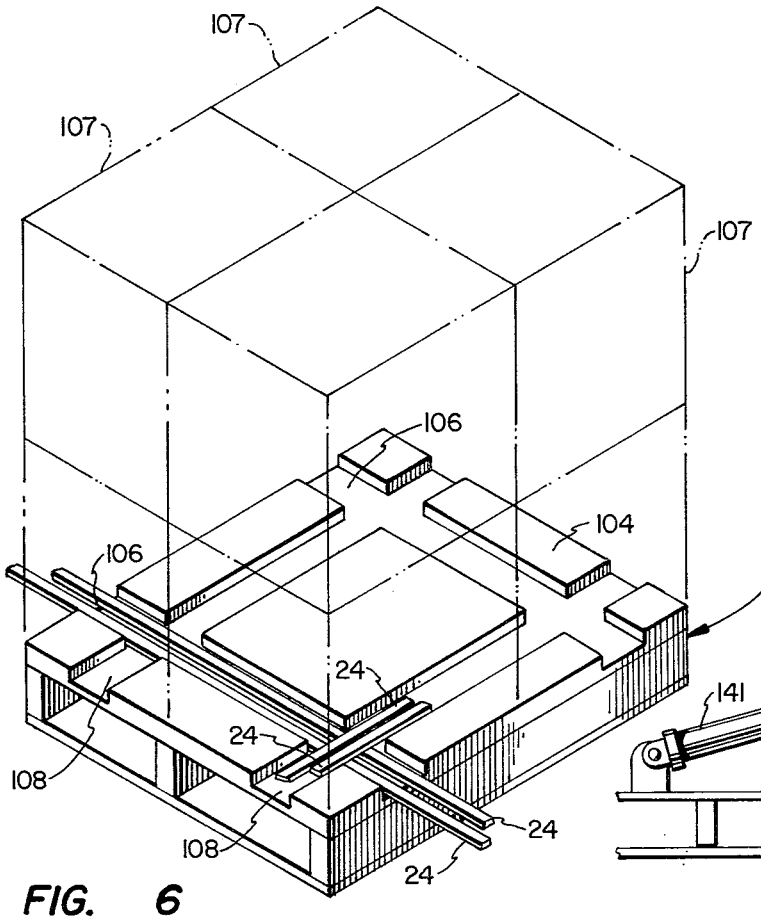
FIG. 6 is a perspective view of an alternate embodiment of a strapping frame or pallet in accordance with the present invention.

Each of the shafts 112 have fixed thereto in spaced apart relationship, reels or drums 120 similar to the reels 32 but modified as will be described herein in conjunction with FIG. 9.

As illustrated in FIG. 7, the shafts 112 are rotatably interconnected at their respective opposite ends with each other by means of bevel gears 122 whereby a shaft system made up of each of the shafts 112 rotates in unison. The cargo handling system includes motive power means for driving the shafts 112 to rotate the reels 120 including an electric motor driven hydrostatic pump/motor unit 124, which may be of a type manufactured by Sperry Corp., Troy, Mich., is mounted on the top surface of the pallet 110, as illustrated. The motor unit 124 is drivably connected to one of the shafts 112 through an endless drive belt 41 in a manner similar to the arrangement of the suspension frame 20.

Different arrangements of driving mechanism may be used to obtain the drive from the motor unit 124 to the shaft system. A battery 42 may be carried on board the pallet 110, as illustrated, or a source of power can be located remote from the suspension frame 100. Moreover, a directly connectable source of hydraulic power fluid could be arranged to be placed in connection with a hydraulic motor instead of placing the power supply on board the suspension frame. A suitable control for controlling the speed and direction of rotation of the motor unit 124 would be provided in accordance with known techniques for hydrostatic type drives.

Figure 8:
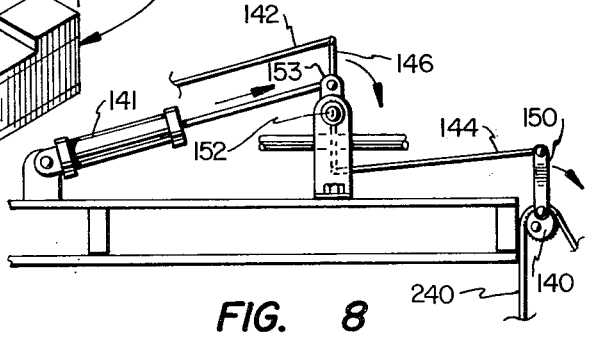
FIG. 8 is a partial elevation view showing details of the strap locking mechanism of the suspension frame of FIG. 7.

The cargo suspension frame 100 is also provided with the eccentric cam type strap lock mechanism of the general type disclosed in conjunction with FIG. 5 of the drawings. The suspension frame 100 is provided with eccentrically mounted cylindrical cams 140 mounted on the sides of the frame member 110 and aligned with respective ones of the reels 120. The cams 140 associated with the reels on parallel pairs of the shafts 112 are operated between their strap gripping and release positions by an interconnected link system. Referring to FIG. 7 and FIG. 8, the cams 140 are interconnected to an actuator 141 by links 142, 144 and 146 which are pivotally interconnected with each other, as illustrated. The link 144 interconnects link 146 and a link 150, the last mentioned link being rigidly connected to the cam 140. In like manner, each link 142 is connected to a link 150 on the opposing cam 140. The links or rocker arms 146 are each fixed to a pivot shaft 152 mounted for pivotal movement on the frame member 110, as shown. The strap locking cam rollers 140 are moved between their gripping and release positions by the actuators 141 comprising hydraulic cylinders connected to the shafts 152 by a crank arm 153, as shown by way of example in FIG. 8. Accordingly, in response to retraction of the piston rods of the cylinders 141, the cam rollers 140 are pivoted to release the associated straps 240 and in response to extension of the piston rod, the cam rollers are pivoted to pinch the straps 240 between the rollers and the adjoining side surfaces of the frame member 110.

The cylinders 141 may be interconnected hydraulically by a suitable control circuit, not shown, to be actuated to cause the cams 140 to grip the straps 240 when the motor unit 124 is driven to wind the straps onto the reels. Alternatively, the cylinders 141 could be actuated independent of the motor unit so that the cams 140 can be actuated to release the straps whereby the straps may be totally reeled onto the reels, if desired, when the suspension frame 100 is being removed from a load.

Yet another procedure may be employed in conjunction with the improved cargo handling system of the present invention by providing the reels 120 to be adapted to be releasably connected to the straps 240. Referring to FIG. 9 of the drawings, a typical example of a reel 120 is illustrated as having a hub portion 170 and spaced apart parallel flanges 172 and 173 for guiding the strap 240 as it is wound onto and off of the reel. Strap 240 includes a closed loop end portion 180 having a tubular support member or grommet 182 suitably secured within the loop portion. The flange 173 has a somewhat V-shaped notch 175 formed therein adjacent a groove 177 in the hub portion 170. A pin 184 projects from the flange 172 into the groove for receiving the grommet 182 of the strap 240 which may be slid on and off the pin in a direction parallel to the axis of rotation of the reel for releasably securing the strap 240 to the reel. Alternatively, a removable pin could be inserted in aligned holes in the flanges 172 and 173 and passed through the tubular member 182 to releasably secure the strap 240 to the reel.

Accordingly, in handling palletized or unpalletized cargo with the suspension frame 100, the straps 240 may be left with the cargo load and the pallet by completely releasing the straps 240 from the frame when it is moved away from the load after being transferred to a desired position. Moreover, when a load is to be picked up by the frame member 110, the straps may be connected to their respective reels by sliding the loop portions 180 through the notches 175 and over the pins 184.

Handling cargo in accordance with the system shown in FIGS. 6 through 9 is enhanced by a procedure utilizing the pallet 102 or pallets of the type disclosed in my aforementioned U.S. patent. Moreover, the hydrostatic drive for the reels 120 is self-locking when the motor unit 124 is deenergized in the same manner that the gear motor 36 for the suspension frame 20 is self-locking and cannot be driven in the reverse direction from the output shaft. Furthermore, by providing a control circuit wherein the cylinders 141 are actuated in conjunction with rotation of the motor in the respective directions to either unwind the straps and release the cam locks simultaneously, or wind the straps and move the cam locks to the gripping position, the speed with which cargo may be picked up, moved and deposited with the apparatus of the present invention, is greatly enhanced.

In operation, the cargo handling system 100 may be used according to the following sequence, in general. Cargo units such as bags or boxes 107, having a generally uniform rectangular shape, are brought to the loading area by conventional means. Assuming that the boxes or bags are substantially identical cargo units in terms of size and shape, they may be stacked uniformly on the support frame or pallet 102. Straps 24 or 240 are then unreeled from the reels 120 of the suspension frame 100 and run beneath the aggregated block of cargo units by sliding the free ends of the straps through the channels 106 and 108. Alternatively, the straps may be previously disconnected from the reels 120 and laid in the channels in the pallet 102 awaiting stacking of the cargo on the pallet. The straps are then brought up to the suspension frame 100 on a side opposite the side of origin for that particular strap. If the straps 240 are being used and have been previously completely disconnected from the suspension frame, each strap must be connected to its respective reel 120 by sliding the grommet 182 over the connecting pin 184, as described in conjunction with FIG. 9 of the drawings. The opposite ends of the straps are then inserted into the cam locks 140 so that upon actuation of the cams, the straps may be secured against the frame member 110. Upon tightening of the straps by driving the shafts 112 to wind all of the straps onto their respective reels, the cargo is ready for movement by a forklift truck or the like, either directly into the transport container or vehicle or into position for loading on a ship by means of a cargo crane. Upon reaching the final placement on board the cargo conveyance, the aforementioned controls for the suspension frame 100 are actuated to cause the reels 120 to unwind the straps 240 and the cylinders 141 are actuated to release the cam locks 140. The straps may then be disconnected from the reels 120 and left with the block or load of cargo, or by alternate operation of the controls, the cam locks may be released while at the same time the motor unit 124 is operated to cause the straps to be wound onto the reels whereby the straps are pulled from beneath the load in opposite directions and wound completely on the reels.

The suspension frame 100 is now ready to be removed from the cargo load and returned to pick up another load. The sequence just described may be repeated in one or the other of its alternate forms.

If the method and equipment described in my aforementioned U.S. Pat. No. 3,494,490 is used in conjunction with the suspension frame 100, the operation would be as follows. When cargo units arrive at the dock, they would be stored on the two narrow pallets. When loading ships, for example, the operator of the cargo system would take a pallet of cargo units and place it on the depalletizer to remove the pallets. The depalletized load would then be carried on forks and placed on the cargo frame or pallet 102. As described above, straps 24 or 240 would already be in place in the channels 106 and 108 or subsequently run through the channels after the cargo is deposited on the frame or pallet 102. If the load consisted of flat bottom boxes or the like, it might be necessary to push the load off of the carrying mechanism, such as a forklift truck or the like when placing the load on the frame 102. At this point, the operation to hook up the suspension frame 100 would be as described above. Moreover, loads resting on the dual narrow pallets could be connected directly to the suspension frame 100 by running the straps 24 or 240 under the load while it was on the narrow pallets.

Although several embodiments of the present invention have been described in detail herein, those skilled in the art will realize that further substitutions and modifications may be made in accordance with the structure and method of the present invention without departing from the scope and spirit of the appended claims.

What I claim is:

1. A cargo handling system for loading and unloading a cargo load comprising one or more discrete cargo units with respect to a conveyance for said load, said system comprising:

a plurality of flexible cargo straps;

a cargo suspension frame adapted to mount on top of said load, said suspension frame including a generally rectangular frame member, a plurality of strap winding and unwinding reels mounted along at least one side of said frame member, power means on said frame member and drivably connected to said reels for rotating said reels, releasable strap locking means mounted along a side of said frame member opposite said reels, said locking means being operable to receive and retain said straps when said reels are rotated to tighten said straps around said load, said locking means for each said straps comprising a cam characterized by a generally cylindrical roller, a support bracket for said roller mounted on said frame member and supporting said roller for rotation about an axis eccentric to the central axis of said roller, said strap being engageable with said roller for securing said strap by a wedging action between said roller and a surface on said suspension frame, and said locking means comprises linkage connected to said cams and operable, at will, to rotate said rollers to release said straps; and means on said suspension frame for engaging said suspension frame by cargo transport means to move said load.

2. The system set forth in claim 1 together with:

means for yieldably biasing said cams into locking engagement with said straps.

3. The system set forth in claim 2 wherein:

said biasing means includes a spring connected to said linkage and said suspension frame.

4. The system set forth in claim 1 wherein:

said linkage includes a crank arm rigidly connected to said cam for rotating said cam, a pivot shaft mounted on said suspension frame, a crank arm connected to said pivot shaft, and a link interconnecting said crank arms and operable in response to rotation of said pivot shaft to rotate said cams to release said straps.

5. The system set forth in claim 4 together with:

power actuator means operably connected to said pivot shaft for rotating said pivot shaft to cause said cams to release said straps.

6. The system set forth in claim 1 wherein:

said straps and said reels are provided with cooperating means for releasably connecting each of said straps at one end thereof to respective ones of said reels.

7. The system set forth in claim 6 wherein:

said reels each include a cylindrical hub portion, parallel flanges disposed on opposite sides of said hub portion, at least one of said flanges including a notch formed adjacent a pin fixed to said reel, said pin being adapted to receive said cooperating means on said strap for releasably retaining said strap connected to said reel.

8. The system set forth in claim 1 together with:

means for supporting a plurality of said cargo units to form said load, said means comprising a cargo support frame having a generally rectangular floor, and a plurality of parallel channels on the surface of said floor for receiving said straps.

9. The system set forth in claim 8 wherein:

said support frame includes at least two spaced apart upstanding walls joined to said floor for containing unstable cargo units on said support frame.

10. A cargo handling system for loading and unloading a cargo load comprising one or more discrete cargo units with respect to a conveyance for said load, said system comprising:

a plurality of flexible cargo straps;

a cargo suspension frame adapted to mount on top of said load, said suspension frame including a generally rectangular frame member, a plurality of strap winding and unwinding reels mounted along at least one side of said frame member, power means on said frame member and drivably connected to said reels for rotating said reels, means on each of said reels cooperable with means on one end of each of said straps to be wound on said reels, respectively, for releasably connecting said straps to said reels, respectively, releasable strap locking means mounted along a side of said frame member opposite said reels, said locking means being operable to receive and retain said straps when said reels are rotated to tighten said straps around said load, said locking means for each of said straps comprising cam means for securing said straps, respectively, by a wedging action between said cam means and a surface on said suspension frame, and said locking means comprises linkage connected to said cam means and operable, at will, to actuate said cam means to release said straps; and means on said suspension frame for engaging said suspension frame by cargo transport means to move said load.

11. The system set forth in claim 10 wherein:

said reels each include a cylindrical hub portion, parallel flanges disposed on opposite sides of said hub portion, at least one of said flanges including a notch formed adjacent a pin fixed to said reel, said pin being adapted to receive said one end of said strap for releasably retaining said strap connected to said reel.

12. A method for moving cargo from one point to another, said cargo comprising unitized loads made up of one or more cargo units, said method comprising the steps of:

providing a plurality of elongated flexible straps;

providing a suspension frame comprising a frame member having a plurality of strap winding reels disposed along at least one side thereof, said straps and said reels being provided with means for releasably connecting said straps to said reels at one end of said straps, respectively, and locking means for engaging and releasably locking said straps to said suspension frame disposed along an opposite side of said frame member;

placing said suspension frame generally directly above said load;

placing said straps under said load with opposite ends of said straps being trained generally vertically upward along opposite sides of said load;

connecting each of said straps at one end to said reels, respectively, and engaging said straps with said locking means adjacent the opposite ends of said straps, respectively;

winding said straps on respective ones of said reels to tighten said straps under said load;

lifting said suspension frame and said load and moving said load to a destination;

placing said load on a support surface at said destination;

actuation said locking means to release one end of each of said straps;

disengaging the other end of each of said straps from said reels, respectively; and removing said suspension frame from said load while leaving said straps under said load.

* * * * *